United States Patent [19]

Herkens et al.

[11] Patent Number: 4,864,950

[45] Date of Patent: Sep. 12, 1989

[54] ICEBREAKER

[75] Inventors: Hermann Herkens, Emden; Oskar Schüler, Warsingsfehn, both of Fed. Rep. of Germany

[73] Assignee: Thyssen Nordeseewerke GmbH, Fed. Rep. of Germany

[21] Appl. No.: 87,033

[22] Filed: Aug. 19, 1987

[30] Foreign Application Priority Data

Sep. 9, 1986 [DE] Fed. Rep. of Germany ..... 3630578

[51] Int. Cl.[4] ..... B63B 35/08

[52] U.S. Cl. ..... 114/40

[58] Field of Search ..... 114/40, 41, 42, 43, 114/67 R, 67 A

[56] References Cited

U.S. PATENT DOCUMENTS

| | | | |
|---|---|---|---|
| 2,366,162 | 1/1945 | Vang | 114/67 R |
| 3,665,886 | 5/1972 | German | 114/40 |
| 3,985,091 | 10/1976 | Waas | 114/40 |
| 4,029,035 | 6/1977 | German | 114/40 |
| 4,075,964 | 2/1978 | Sjogren | 114/40 |
| 4,543,900 | 10/1985 | Aker | 114/40 |

*Primary Examiner*—Joseph F. Peters, Jr.
*Assistant Examiner*—Jesûs D. Sotelo

[57] ABSTRACT

For reducing the adhesive and frictional forces of snow and ice acting on the outer hull plating of an icebreaker and in particular static frictional forces when the ship becomes stuck in the ice, use is made of heating sources present and available in the hull, in order to keep warm the critical outer hull plating zones, a mixture of outside water and hot exhaust gases from the engines being ejected in the critical outer plating zone.

9 Claims, 3 Drawing Sheets

ICEBREAKER

BACKGROUND OF THE INVENTION

The present invention relates to an icebreaker.

In the case of ships having traditional icebreaking configurations with pointed bows, very high external forces are introduced horizontally into the ice surface by means of the hull plating particularly in the water line region, the wedge-shaped bow water lines and the front shoulders of the hull form, the ice surface being destroyed by compression and bending breaks. The high external forces, particularly in said critical plating zones, lead to very high friction force components, which are prejudicial to the bending breakage of the ice surface and the propulsion of the ship.

In the case of ships having a favourable icebreaking bow shape, break lines are produced in the ice in front of the ship and run at right angles to the longitudinal axis of the ship. Thus, ice floes are obtained, which initially have a width corresponding to that of the hull. These ice floes are forced under the hull, at a certain depth are broken in planned manner into two halves and are then led away to the side. In this process, the ice floe with its original surface is guided by the outer plating of the prow. At its leading edge the floe is supported against the unbroken ice. The supporting force acts on the unbroken ice in bottom to front sloping manner and its action direction is opposed with one component to the force intended to crush the ice in front of the ship into the aforementioned ship-wide floes and consequently reduces the breaking force. The ship must simultaneously apply the longitudinal component of this force through increased propeller or screw thrust. As the longitudinal component of the breaking force must also be consumed by the propeller thrust, the supporting of the broken floe and all floes behind it in the forwards direction has a double effect on the propeller thrust, in which all floes "stick" under the ship's bottom jointly have a double action, firstly due to the frictional force component opposing the thrust and secondly through the frictional force component opposing the breaking force. The first frictional force component consequently requires a higher propeller thrust, even if the friction is absorbed by surroundings other than the frontally positioned ice. The second component cancels out part of the breaking force, so that through a further increase in the thrust and consequently the ship must be moved even higher onto the ice than if no frictional force were present.

DE-OS 21 12 334 discloses a ship with an icebreaking bow, whose hull passes into an underwater prow with two wedge-shaped icebreaker stems forming a channel between them. At the rear end of the channel is provided a snowplough-like guide device beneath the ship's bottom. The resulting much smaller ice floes cannot be moved under the lateral, fixed ice cover and instead float in the gap between the hull and the lateral fixed ice cover and cause increased friction on the hull plating or collect in the channel and slide midships under the vessel into the propeller region. Thus, such a ship has an increased power requirement and the propellers are exposed to the damaging effects of the ice floes.

Furthermore, European patent 00 79 002 discloses the shape of a prow, e.g. for icebreakers. For travelling in open or ice-covered waters, the ship is provided with a pontoon-like prow located above the water line, which has parallel side walls and an end face extending over the entire width of the ship which, in the underwater part, is planer and slopes greatly forward. Towards the rear it passes into a centre keel and is provided with a stern and drive means housed in the latter. The construction is such that the lateral edges in the transition region between the prow side walls and the end face are curved in the longitudinal direction of the lateral edges and protrude laterally with respect to the planes formed by the prow side walls, so that the distance between the lateral edges located below the construction water line forms the maximum width of the underwater ship. The under sides of the frames between the two lateral edges from the point of the ship's length at which the end face passes into the centre keel and up to the point at which it reaches the ship's bottom are constructed athwartships in downwardly curved or bent manner. This construction is intended to provide a ship with a limited power requirement for propulsion without great technical, design expenditure and in particular with icebreaking characteristics. In addition, there are even more favourable conditions for the shear fracture of a one-piece floe from the fixed ice cover, accompanied by an improvement in the guidance of the floe under the water with reduced risk of crushing thereof into small pieces, so that the lateral transfer of the floe below the fixed ice cover is even more reliably achieved.

In all icebreakers, the support of the broken ice floe and the ice floes behind it in the forward direction has a multiple effect in the propeller thrust. This forward support would not be necessary if there were no frictional forces between the hull plating and the ice surface of the submerged ice floes. These frictional forces can never be completely prevented, but the magnitude thereof is decisively dependent on the contact between the ice surface and the outer plating. Vital importance is attached to the presence of a lubricating film between the outer plating and the ice. Even if no water can penetrate the space between the outer plating and the ice, in the case of a sufficiently large relative movement between ship and ice, the frictional heat in itself forms a lubricating film from the melted ice. In addition, the thermal state of this region is such that the melting heat is greater than the heat removed. However, this no longer applies in the case of slow ships movements, i.e. in the limit range of icebreaking by the ship and with very low outside temperatures. The small frictional heat produced at such a low speed is rapidly removed again by the very cold, surrounding ice and by the very cold steel of the hull plating, so that at the most there is dry friction leading to a very high frictional force. When movement is topped, it is even possible for the ice floe to freeze solid with the steel of the outer plating, so that it is very difficult to detach the said ice floe from the ship.

SUMMARY OF THE INVENTION

The problem of the present invention in the case of an icebreaker is to reduce the icebreaking resistance by reducing the outer plating friction.

This problem is solved by the characterising features of claim 1.

Thus, the icebreaking resistance of an icebreaker is reduced by decreasing outer plating friction, which is brought about in that heat is supplied to the critical outer plating zones or through higher frequency vibrations or oscillations being produced there. This problem is also solved by water lubrication when the ship is stationary.

According to the invention in the hull plating zones, where there is increased friction or adhesive forces, outlet ports are provided through which is ejected a mixture of external water and hot exhaust gases from the engines. Whereas in the case of conventional ice nozzle plants air is sucked into the nozzles acting as ejectors through the propulsive water, so that there is an air/water mixture at the ejector outlet, according to the inventive solution use is made of an exhaust gas/water mixture, the exhaust gas being taken from the engines, i.e. the main propulsive machinery of the ship. The exhaust gas from the latter necessary for the mixture is taken between said machinery and the silencer from the exhaust gas line leading to the smoke stack. The exhaust gas is supplied by means of a blower to the nozzles and as the latter act as ejectors during operation, the blower pressure can be kept low. As a function of the nature, design and loading of the main propulsive machinery, the exhaust gas temperature between the exhaust gas boiler and the silencer in the exhaust gas line from the machinery can be kept over 180° C. The energy loading due to the blower used is, e.g. in the case of 20 nozzles and a blower or blast pressure of 100 mm WS, approximately 2 kW. If the propulsive water supply is stopped, the hot exhaust gas still passing out of the nozzle protects the equipment from freezing up.

The advantage of using an exhaust gas/water mixture is that the nozzle system is independent of the cold outside air. As a function of the exhaust gas quantity, exhaust gas temperature and propulsive water quantity, there is even a slight heating of the propulsive water in the nozzle. In the case of closed propulsive water fittings, there is a constant heating of the nozzles and nozzle outlets by the escaping exhaust gas, so that they are protected against freezing. The device for reducing the ice friction resistance with the nozzles is preferably located in the sloping end face of the prow, but it is also possible to arrange the nozzles throughout the hull plating zone, i.e. in all critical plating zones. However, preference is given to the positioning in the vicinity of the prow, so as to contribute to the heating of the outer plating of the end face.

According to another feature of the invention, the outer plating zones of the hull, where there is increased ice friction or adhesive forces, are heated from the interior of the hull. This heating preferably takes place from the interior through providing tanks or chambers for water, fuels or the liquid cargo adjacent to the hull plating, the tank liquids being heated to at least a temperature somewhat above the freezing point of the external water. The heating of the hull interior can also be broughtabout by guiding hot engine gases along the necessary outer plating surfaces or by passing hot fuel along the necessary outer plating surfaces.

If the icebreaker is in preferred manner provided with an approximately pontoon-shaped prow with two lateral edges forming the greatest width of the underwater ship, which pass through the water line becoming narrower behind them at the bow, such a prow configuration with outlet ports for a water/exhaust gas mixture makes it possible to overcome the problems occuring in known icebreakers through the supply of heat. Due to the heating of the entire hull plating of the inclined end face of the prow, along which already slide broken ice floes, the removal of the friction heat becomes impossible, so that even when the ship is stationary the water lubricating film is always retained, so as to reduce the aforementioned double effect of already broken ice floes on the icebreaking resistance. The heat supply takes place in such a way that a medium located above the outer plating and mainly ballast water or fuel, is kept by means of heating devices at a constant temperature a few degrees above the melting point of the ice.

Further advantageous developments of the invention can be gathered from the subclaims.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
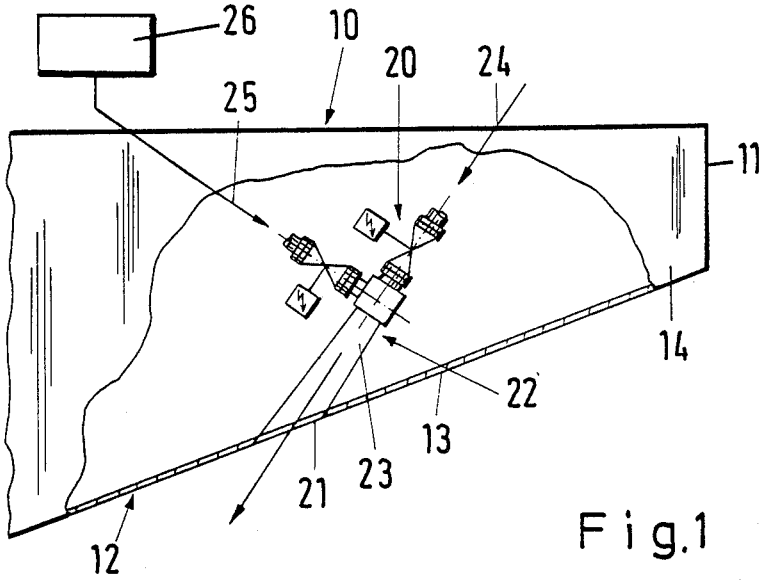
FIG. 1 the arrangement of a nozzle operated by an exhaust gas/propulsive water mixture in the outer plating of the sloping end face of a pontoon-like prow in diagrammatic side view.

FIGS. 1 and 3–5 show an embodiment of a pontoon-shaped prow 10 of a hull 100 of an icebreaker. In prow 10, the icebreaker has a forwardly upwardly sloping end face 12 extending over a significant part of the width of the ship. The outer lateral edges of the end face 12 are defined by two longitudinally directed and preferably partly curved lateral edges 14, whereof only one is visible in FIGS. 1 and 3–5. These lateral edges 14 can project laterally with respect to the hull located above them. The end face 12 of prow 10 can be increasingly downwardly curved or bent athwartships from front to rear. Apart from a planar configuration of the strongly forwardly inclined end face 12 of prow 10, said end face 12 can also be convex or concave. Laterally end face 12 of prow 10 passes into side walls 11, whereof only one is visible in FIGS. 1 and 3–5. The outer plating of end face 12 of prow 10 is indicated at 13.

In the vicinity of the outer plating 13 of hull 100 and/or in the outer plating of the inclined end face 12 of prow 10, i.e. in the vicinity of the stem, is provided a device 20 for reducing ice friction resistance (FIG. 1).

This ice friction reducing device 20 comprises a plurality of outlet ports 21 formed in the outer plating 13 or in the outer plating of end face 12 and through which a mixture of outside water and hot exhaust gases from machinery 26 is ejected. In the embodiment shown in FIG. 1, an outlet port 21 is shown in the outer plating 13 of end face 12. In the vicinity of said outlet port 21 is located a nozzle 22, which is constructed as an ejector, as indicated at 23. The outside water is supplied via 24 to nozzle 22, whilst the exhaust gas is supplied in the direction of arrow 25 by means of pipelines, which are not shown in the drawings.

The outlet ports are provided throughout the outer plating at points where critical zones have to be kept warm, so that the frictional forces due to snow and ice acting on outer plating 13 of hull 100 are reduced. Apart from the heat sources present in the hull, energy sources from the vessel propulsive machinery 26 can also be used for producing higher frequency oscillations or vibrations.

Figure 2:
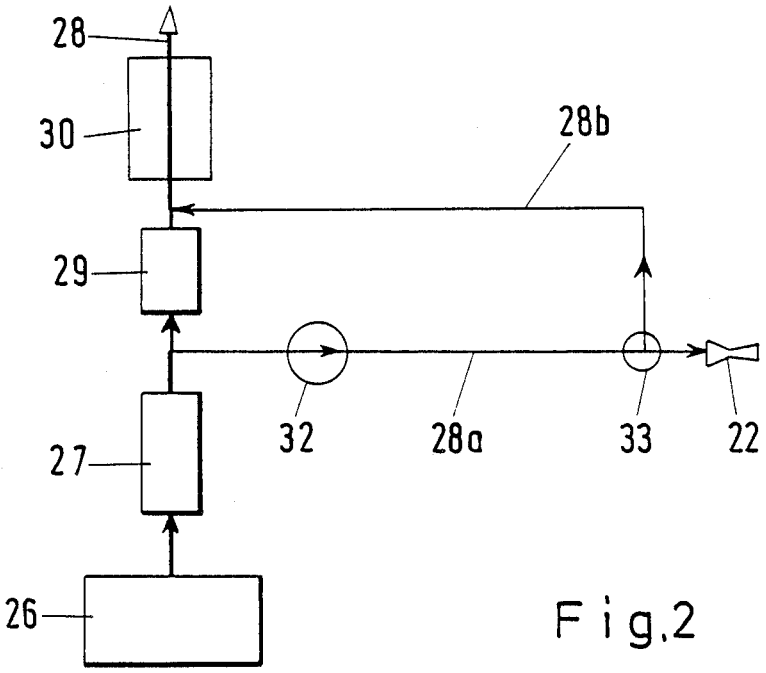
FIG. 2 the operation of the nozzle by means of exhaust gas, which is taken from the exhaust gas line from the main propulsive machinery of the ship, in a diagrammatic view.

The exhaust gas for nozzles 22 is taken from the exhaust gas line 28, which comes from the main propulsive machinery 26 and which is led into stack 30. According to FIG. 2, exhaust gas line 28 contains an exhaust gas boiler 27 and a silencer 29. The exhaust gas for nozzles 22 is preferably removed between exhaust gas boiler 27 and silencer 29 by means of a pipe **28*a* leading into the exhaust gas line 28 and which passes to nozzle or nozzles 22, said pipe 28*a* containing a blower 32. By means of blower 32, exhaust gas is taken from exhaust gas line 28 and supplied to nozzle 22. The supply of exhaust gas to nozzle 22 can be regulated by means of a three-way valve 33. The return of exhaust gas from the three-way valve to exhaust gas line 28 takes place via pipe 28*b* and namely, as can be seen in FIG. 2, between silencer 29 and stack 30**.

The exhaust gas taken from exhaust gas line 28 in most cases has a temperature above 180° C. In the case of higher exhaust gas temperatures, it is possible by means of a heat exchanger incorporated into pipe **28*a*** to bring the exhaust gas temperature to the desired temperature.

Nozzles 22 are preferably located in the hull plating 13, namely in the critical outer zones thereof, which must be kept warm, or in the outer plating of end face 12 of prow 10, as shown in FIG. 1. The number of nozzles 22 provided will be a function of the size of the zone to be kept warm or the end face 12. However, the possibility also exists of arranging nozzles in further prow areas or in the outer plating of the hull connected to the prow in the underwater region, so that it is consequently possible to reduce the ice friction resistance and then all these nozzles can be operated with a mixture of exhaust gas and propulsive water.

Figure 3:
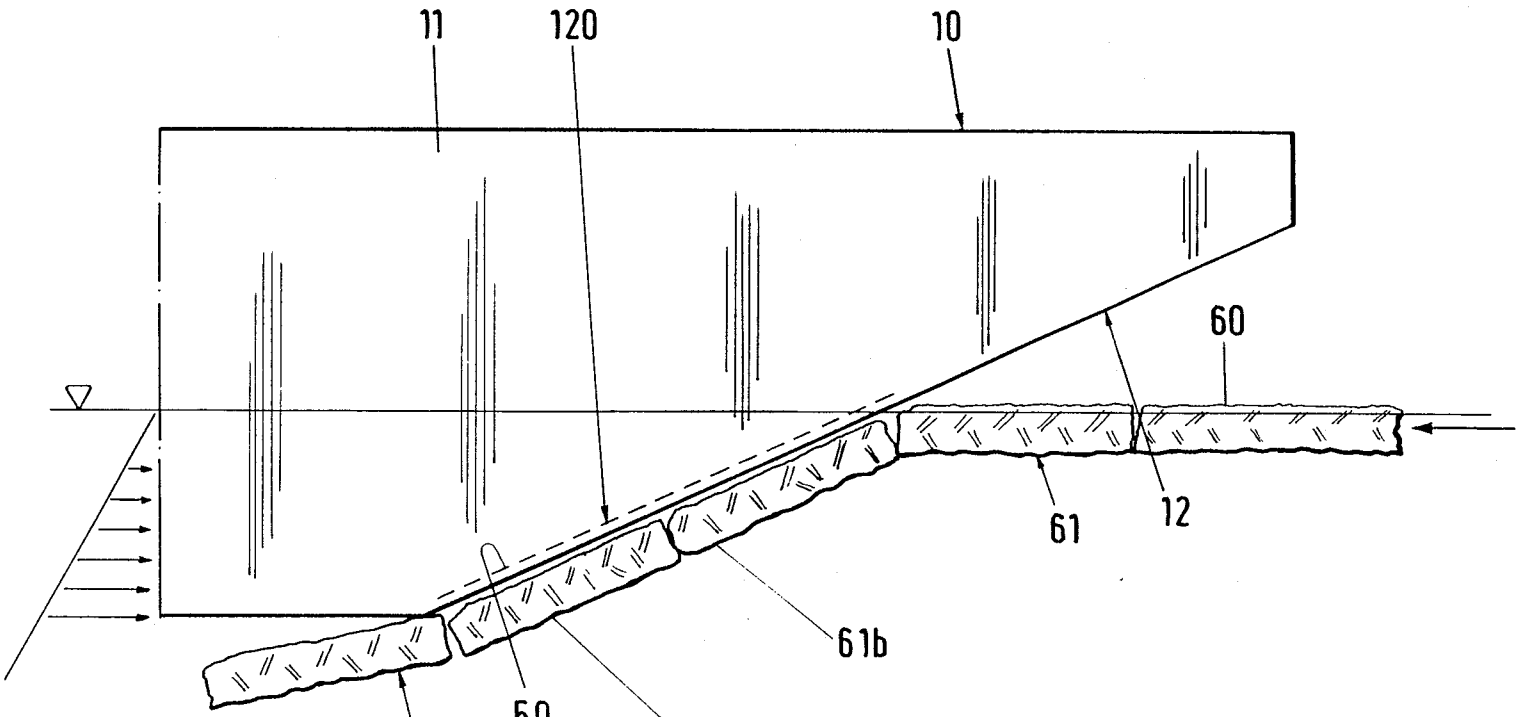
FIG. 3 the prow of an icebreaker with an outer plating heating device in side view.
Figures 4, 5:
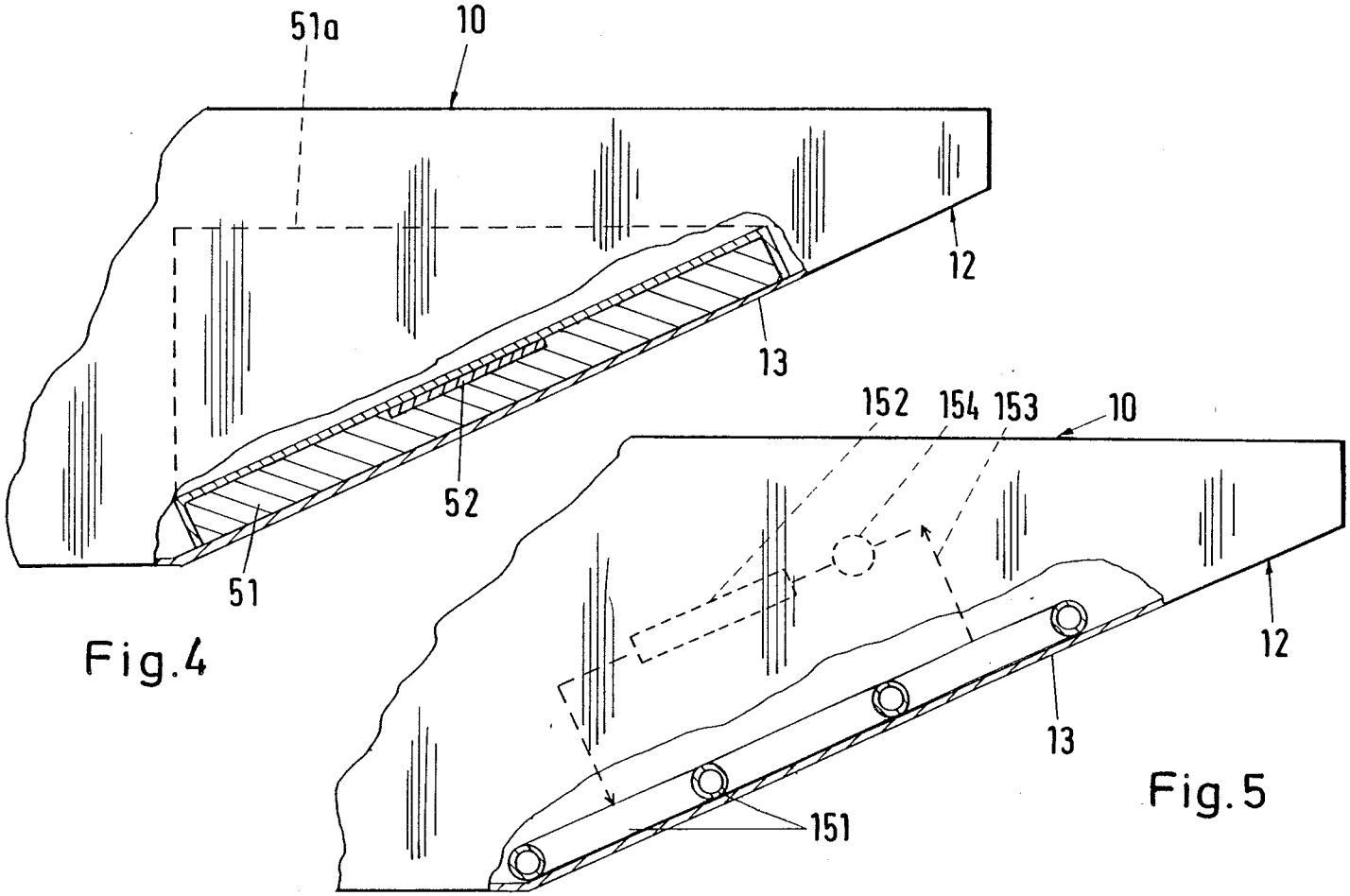
FIG. 4 an embodiment of the outer plating heating device, in which heating takes place by means of ballast water or fuel, partly in side view and partly in vertical section.
FIG. 5 another embodiment of a prow outer plating heating device, which comprises a pipeline system through which flows a liquid or gaseous medium, partly in view and partly in vertical section.

The embodiment shown in FIGS. 3–5 represents a prow 10 for an icebreaker with a sloping and preferably planar end face 12, which can also be in the form of a convex or concave surface. The outer plating 13 of end face 12 of prow 10 is also provided with a device 120 for reducing ice friction resistance, but comprises a means 50 heating the inclined end face 12 or the outer plating 13 thereof, so that said end face, to the extent that it has friction contact with broken ice, is kept at a temperature above the melting point of the ice through the supply of heat. The fixed ice cover is indicated at 60 in FIG. 3, whilst the broken ice floes are designated 61. With respect to the broken ice floes 61, floes **61*a*, 61*b* slide along the outer plating 13 of end face 12 of prow 10**.

The outer plating zones of the hull, where there is greater ice friction or adhesive forces, can also be heated from the interior of the hull, said heating being provided by arranging tanks or chambers 51 for water, fuels or liquid cargo adjacent to the hull plating and, by heating, the tank liquids are brought to a temperature which is at least somewhat above the freezing point of the outside water, or by hot engine gases passing along the necessary outer plating surfaces. The heating from the interior of the hull can also be brought about by hot operating fluids passing along the necessary outer plating surfaces.

An advantageous embodiment of the invention comprises increasing the area of the critical outer plating zones by a corrugated configuration of the outer plating, thereby increasing the amount of heat introduced. In the case of an appropriate arrangement of the corrugation profile in the direction of the flow lines, it is simultaneously possible to reduce slamming phenomena in the motion of the sea.

The heating means 50 for outer plating 13 of end face 12 of prow 10, can be constructed in the most varied ways, as shown in FIGS. 4 and 5. It is particularly advantageous if heating means 50 comprises a pipe line system 151 guided along the particular outer plating zones and through which flows in circuit manner a liquid or gaseous medium and which is kept by means of heating device 52 at a constant temperature above the melting point of the ice.

According to FIG. 4, heating means 50 comprises a chamber 51 arranged over the sloping end face 12 and extends over the entire end face. Chamber 51 can have the construction shown if FIG. 4, but it is also possible for it to have the shape indicated at **51*a***.

Chamber 51 is used for receiving e.g. water, ballast water, fuels or liquid cargo, but can also be filled with another, preferably liquid medium. This medium, e.g. ballast water or fuel, can be heated by means of a heating device 52 positioned outside or inside chamber 51. In the embodiment shown in FIG. 4, heating device 52 is located in the interior of chamber 51, so that the heat transfer from heating device 52 to the medium in chamber 51 takes place directly. If heating device 52 is positioned in the prow 10 outside chamber 51, then the medium is passed through heating device 52 into the interior of chamber 51 in circuit manner by means of a pipe line system not shown in the drawing and using a pump, so that the medium always has the desired temperature in chamber 51.

Heating device 52 can be constituted by an electric resistance heating means. However, it is also possible to use heat exchangers, which can e.g. be operated with the exhaust gas from the main propulsion machinery, so that no additional energy sources are required for heating device 52. However, it is also possible to use differently constructed, conventional heating devices. It is important that the entire end face 12 or its outer plating 13 is kept at a temperature above the melting point of the ice through the supply of heat. The outer plating 13 is preferably kept at a constant temperature a few degrees above the melting point of the ice. Chamber 51 is preferably located in the areas of the hull plating, which must be kept warm. Instead of a single chamber, several individual chambers can be provided. In place of chambers, it is also possible to use containers, which are in contact with the outer plating to be heated, the containers then being made from a material which has a high thermal conductivity.

Another embodiment of a heating means 50 for the outer plating 13 of prow 10 is shown in FIG. 5. In this case, heating means 50 comprises a pipeline system 151, through which is passed in circuit form a gaseous or liquid medium. The gaseous medium can be in the form of exhaust gases taken from the main propulsion machinery of the ship. Alternatively liquid media can be used, which are brought to the necessary temperature by means of the heating device indicated at 152 and are then kept at this temperature. The circuit for the medium heating the outer plating 13 is designated 153. The circulation of the medium takes place by means of a pump 154. The pipeline system 151 can comprise pipes arranged on the inside of outer plating 13 in the longitudinal direction of the hull, pipes running at right angles to said longitudinal direction, or pipelines joined in lattice-like manner.

It is also possible to provide the end face 12 with a chamber system, not shown in the drawings, through which is constantly passed the heated, i.e. hot exhaust gases or a heated liquid medium, which gives off its heat to outer plating 13 and brings same to the desired temperature.

If the icebreaker is provided with an approximately pontoon-shaped prow with two lateral edges forming the greatest width of the underwater ship and which pass through the water line narrowing behind them at the bow, then the lateral edges can be provided with heating devices for increased heat supply. The heating device can be regulated in such a way that the heat supply in the lateral edges produces a temperature ensuring that a melted ice lubricating film adapted to the ice conditions is ensured.

Preferably the water lubricating film thickness is adapted in optimum manner to the particular icebreaking states, i.e. the temperature of the heating device can be adapted in accordance with the necessary lubricating film thickness. The water passing out of the outlet ports in the ship's bottom can be diverted and ejected without adding air or gas at the sides above the lateral edges and abeam with respect to the longitudinal axis of the ship.

Figure 6:
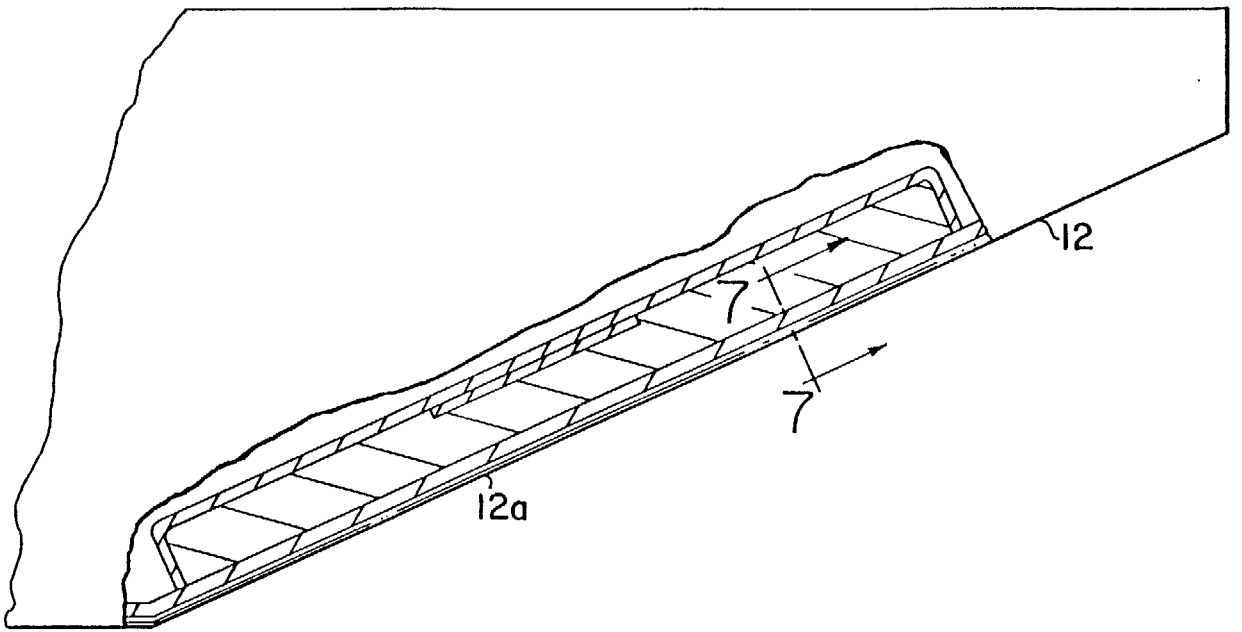
FIG. 6 shows still another embodiment of a prow outer plating heating device, in which the outer face of the plating is corrugated.
Figure 7:
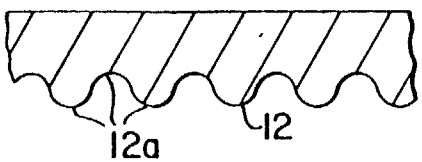
FIG. 7 is an enlarge sectional view taken generally on the line 7,7 of FIG. 6.

To achieve an optimum action with a minimum heat requirement, end face 12 can be provided with a corrugated profile as shown in FIGS. 6 and 7. The depressions and protuberance 12*a* of the corrugated profile extending in the longitudinal direction of the hull. This increases the surface of the outer plating and optimizes the heating of the latter.

Preferably the outer plating 13 of end face 12 of prow 10 is heated in those areas along which the broken ice floes 61*a*, 61*b* slide. However, it is also possible to heat the entire outer plating 13 of end face 12 and the hull plating in the underwater region.

What is claimed is:

1. In an icebreaker having a hull and a propulsion system producing heat and exhaust gases, the improvement comprising:

prow means at the forward end of the hull and including plating zones, said prow means including a front wall facing the forward direction of the hull and extending across the hull, said front wall being of corrugated cross sectional configuration with the corrugations oriented in the direction of forward motion for the hull, means for storing fluid in the hull, and heat exchange means for heating said fluid from said propulsion system heat, means for moving said heated fluid along the interior of said hull in the area of said plating zones, and means for drawing seawater into the hull, and for mixing propulsion system exhaust gases with the seawater, said plating zones of said prow means having outlet ports, and means for forcing the mixture of seawater and exhaust gases through said outlet ports.

2. The combination of claim 1 further characterized by means for imparting mechanical vibrations to the hull in the area of said plating zones.

3. The combination of claim 1 wherein said fluid comprises fuel for the icebreaker's propulsion system.

4. The combination of claim 1 wherein said prow means is wider than the icebreaker's hull and wherein said plating zones comprise the lateral edges of said prow means.

5. The combination of claim 1 wherein said fluid comprises seawater and said means for storing said seawater fluid comprises ballast tanks in the hull of the icebreaker.

6. An icebreaker having a hull and a propulsion system producing heat and exhaust gases, the improvement comprising: prow means of the forward end of the hull and including plating zones, means for storing fluid in the hull, and heat exchange means for heating said fluid from said propulsion system heat, said fluid comprising the fuel for the icebreaker's propulsion system, means for moving said heated fuel along the interior of said hull in the area of said plating zones, and means for drawing seawater into the hull, and for mixing propulsion system exhaust gases with the seawater, said plating zones of said prow means having outlet ports, and means for forcing the mixture of seawater and exhaust gases through said outlet ports.

7. The combination of claim 6 further characterized by means for imparting mechanical vibrations to the hull in the area of said plating zones.

8. The combination of claim 6 wherein said prow means is wider than the icebreaker's hull and wherein said plating zones comprise the lateral edges of said prow means.

9. The combination of claim 6 wherein said prow means has a front wall facing the forward direction of the hull and extending across the hull, said front wall being of corrugated cross sectional configuration with the corrugations oriented in the direction of forward motion for the hull.

* * * * *

UNITED STATES PATENT AND TRADEMARK OFFICE

CERTIFICATE OF CORRECTION

PATENT NO. : 4,864,950

DATED : September 12, 1989

INVENTOR(S) : HErmann Herkens and Oskar Schuler

It is certified that error appears in the above-identified patent and that said Letters Patent is hereby corrected as shown below:

The drawing sheet consisting of Figs. 6 and 7, should be added as shown on the attached page.

Signed and Sealed this

Twenty-fourth Day of July, 1990

*Attest:*

HARRY F. MANBECK, JR.

*Attesting Officer*

*Commissioner of Patents and Trademarks*